US008092647B2

(12) United States Patent
Akhtar et al.

(10) Patent No.: US 8,092,647 B2
(45) Date of Patent: Jan. 10, 2012

(54) METHOD FOR TREATING LIGNOCELLULOSIC MATERIALS

(75) Inventors: Masood Akhtar, Middleton, WI (US); William Robert Kenealy, Madison, WI (US); Eric Horn, Madison, WI (US); Ross E. Swaney, Madison, WI (US)

(73) Assignees: Wisconsin Alumni Research Foundation, Madison, WI (US); The United States of America as represented by the Secretary of Agriculture, Washington, DC (US)

( * ) Notice: Subject to any disclaimer, the term of this patent is extended or adjusted under 35 U.S.C. 154(b) by 369 days.

(21) Appl. No.: 11/994,375

(22) PCT Filed: Jul. 10, 2006

(86) PCT No.: PCT/US2006/026565

§ 371 (c)(1),
(2), (4) Date: Jun. 10, 2008

(87) PCT Pub. No.: WO2007/008689

PCT Pub. Date: Jan. 18, 2007

(65) Prior Publication Data

US 2009/0194243 A1 Aug. 6, 2009

Related U.S. Application Data

(60) Provisional application No. 60/697,507, filed on Jul. 8, 2005.

(51) Int. Cl.

| | |
|---|---|
| ***D21C 3/20*** | (2006.01) |
| ***D21C 1/00*** | (2006.01) |
| ***D21B 1/04*** | (2006.01) |

(52) U.S. Cl. ..... 162/72; 162/76; 162/77

(58) Field of Classification Search ..... 162/63, 162/72, 75, 76, 77

See application file for complete search history.

(56) References Cited

U.S. PATENT DOCUMENTS 1,833,975 A * 12/1931 Richter ..... 162/16

(Continued)

FOREIGN PATENT DOCUMENTS

EP 1036878 A1 * 9/2000

OTHER PUBLICATIONS

Smook, Handbook for Pulp and Paper Technologists, 1992, Angus Wilde Publications, 2nd edition, chapter 4.*

International Search Report and Written Opinion corresponding to PCT/US2006/026565 under date of mailing of Feb. 26, 2007.

Hunt, C., et al., "A biopulping mechanism: Creation of acid groups on fiber," Holzforschung 58:434-439 (2004).

(Continued)

*Primary Examiner* — Matthew Daniels
*Assistant Examiner* — Anthony Calandra
(74) *Attorney, Agent, or Firm* — Quarles & Brady LLP; Sara D. Vinarov

(57) ABSTRACT

The present invention is a method for producing a pulp from a fibrous lignocellulose material or source using a treatment or pretreatment step which exposes the material to oxalic acid derivatives, particularly dialkyl ester derivatives, particularly in the vapor phase. Once treated, the material may be refined using any one of the several pulping methods to produce a final pulp product and the production of the product is accompanied by strength increases in paper made from the pulp and energy savings in making the pulp, hi addition the treatment or pretreatment produces a soluble carbohydrate source and other components (e.g. acetic acid, other wood components) for further product development. In certain cases a pulp product is not produced and all of the carbohydrate present in the lignocellulose is converted into soluble sugars.

22 Claims, 8 Drawing Sheets

U.S. PATENT DOCUMENTS

| | | | | |
|---|---|---|---|---|
| 1,856,567 | A | 5/1932 | Kleinert et al. | |
| 1,925,310 | A * | 9/1933 | Dreyfus | |
| 4,409,032 | A * | 10/1983 | Paszner et al. | 127/37 |
| 4,490,518 | A * | 12/1984 | Fuzesi et al. | 527/401 |
| 4,511,433 | A | 4/1985 | Tournier et al. | |
| 4,851,082 | A * | 7/1989 | Mita et al. | 162/76 |
| 5,705,369 | A | 1/1998 | Torget et al. | |
| 6,569,285 | B2 | 5/2003 | Bryant et al. | |
| 7,306,698 | B2 * | 12/2007 | Akhtar et al. | 162/76 |
| 2003/0041985 | A1 | 3/2003 | Akhtar et al. | |
| 2006/0254731 | A1 * | 11/2006 | Jawaid | 162/4 |

OTHER PUBLICATIONS

Kenealy, W.R., et al., "A new mechanism of biopulping: Attachment of acid groups on fiber," Oct. 2004 Ninth International Conference on Biotechnology, Durban, South Africa.

Swaney, R., et al., "Oxalic Acid Pretreatment for Mechanical Pulping Greatly Improves Paper Strength while Maintaining Scattering Power and Reducing Shives and Triglycerides," 2003 TAPPI Fall Tech. Conference: Engineering, Pulping & PCE&I, Atlanta, GA: TAPPI Press.

* cited by examiner

FIG. 1 Southern yellow pine TMP

| Sample | Burst Index kPa·m²/g | Tear Index mN·m²/g | Tensile Index kN·m/g | Printing opacity % | Scattering coefficient m²/kg | ISO Brightness % | Energy Consumption W·h/kg | CSF ml |
|---|---|---|---|---|---|---|---|---|
| Control | 0.54 | 3.04 | 0.015 | 94.5 | 35.7 | 38.6 | 2,118 | 290 |
| Control | 0.60 | 2.67 | 0.018 | 96.5 | 40.0 | 39.7 | 2,312 | 185 |
| Control | 0.53 | 2.27 | 0.018 | 96.8 | 41.5 | 40.2 | 2,449 | 115 |
| DEO 10ml/kg | 0.71 | 4.32 | 0.018 | 96.6 | 36.3 | 37.8 | 1,261 | 310 |
| DEO 10ml/kg | 0.75 | 3.49 | 0.020 | 97.1 | 40.9 | 41.9 | 1,497 | 161 |
| DEO 10ml/kg | 0.73 | 2.72 | 0.021 | 97.8 | 46.1 | 43.7 | 1,579 | 90 |
| DEO 40ml/kg | 0.66 | 3.29 | 0.017 | 98.8 | 49.1 | 40.0 | 1,143 | 200 |
| DEO 40ml/kg | 0.75 | 2.94 | 0.020 | 99.1 | 53.3 | 40.7 | 1,316 | 75 |
| DEO 40ml/kg | 0.76 | 2.82 | 0.021 | 99.2 | 54.4 | 40.4 | 1,368 | 38 |

FIG. 2. Spruce TMP

| Sample | Burst Index kPa·m²/g | Tear Index mN·m²/g | Tensile Index kN·m/g | Printing opacity % | Scattering coefficient m²/kg | ISO Brightness % | Energy Consumption W·h/kg | CSF ml |
|---|---|---|---|---|---|---|---|---|
| Control | 0.84 | 4.49 | 0.0222 | 94.7 | 41.7 | 44.0 | 2,143 | 333 |
| Control | 1.34 | 4.70 | 0.0343 | 96.7 | 46.5 | 44.6 | 2,639 | 160 |
| Control | 1.26 | 4.24 | 0.0330 | 96.4 | 47.8 | 45.4 | 2,781 | 125 |
| DEO 10ml/kg | 1.15 | 5.26 | 0.0262 | 97.0 | 46.2 | 44.3 | 1,520 | 260 |
| DEO 10ml/kg | 1.35 | 5.44 | 0.0299 | 97.4 | 48.7 | 44.9 | 1,950 | 133 |
| DEO 10ml/kg | 1.36 | 4.99 | 0.0318 | 97.8 | 53.7 | 45.8 | 2,136 | 85 |
| DEO 20ml/kg | 1.25 | 5.70 | 0.0284 | 97.3 | 50.0 | 47.3 | 1,450 | 185 |
| DEO 20ml/kg | 1.55 | 5.33 | 0.0322 | 98.0 | 55.9 | 48.3 | 1,798 | 98 |
| DEO 20ml/kg | 1.60 | 4.87 | 0.0358 | 98.5 | 58.6 | 48.3 | 2,020 | 47 |

FIG. 3. Aspen TMP

| Sample | Burst Index $kPa \cdot m^2/g$ | Tear Index $mN \cdot m^2/g$ | Tensile Index $kN \cdot m/g$ | Energy Consumption $W \cdot h/kg$ | CSF ml |
|---|---|---|---|---|---|
| Control | 0.10 | 1.88 | 0.0122 | 2,066 | 340 |
| Control | 0.33 | 1.88 | 0.0142 | 2,200 | 280 |
| Control | 0.50 | 2.04 | 0.0154 | 2,422 | 200 |
| DEO 10ml/kg | 0.11 | 1.69 | 0.0114 | 1,072 | 320 |
| DEO 10ml/kg | 0.58 | 2.16 | 0.0190 | 1,360 | 230 |
| DEO 10ml/kg | 0.49 | 2.07 | 0.0159 | 1,493 | 189 |
| DEO 40ml/kg | 0.14 | 1.82 | 0.0122 | 634 | 328 |
| DEO 40ml/kg | 0.60 | 2.24 | 0.0171 | 1,061 | 148 |
| DEO 40ml/kg | 0.61 | 2.15 | 0.0182 | 1,157 | 102 |

FIG. 4. Maple TMP

| Sample | Burst Index $kPa*m^2/g$ | Tear Index $mN*m^2/g$ | Tensile Index kN*m/g | Energy Consumption W*h/kg | CSF ml |
|---|---|---|---|---|---|
| Control | 0.03 | 0.81 | 0.0055 | 2,150 | 362 |
| Control | 0.03 | 0.75 | 0.0056 | 2,340 | 302 |
| Control | 0.04 | 0.87 | 0.0082 | 2,581 | 218 |
| DEO 10ml/kg | 0.07 | 1.43 | 0.0096 | 1,120 | 285 |
| DEO 10ml/kg | 0.08 | 1.41 | 0.0108 | 1,350 | 215 |
| DEO 10ml/kg | 0.22 | 1.48 | 0.0129 | 1,532 | 155 |
| DEO 40ml/kg | 0.46 | 1.13 | 0.0153 | 746 | 148 |
| DEO 40ml/kg | 0.51 | 1.23 | 0.0168 | 863 | 114 |
| DEO 40ml/kg | 0.62 | 1.37 | 0.0193 | 1,043 | 54 |

FIG. 5. Chemical Pulping Conditions

| Wood Chips Species | Starting Amount (grams) | Active Alkaline (%) | Liquor to Wood Ratio (L/W) | Sulfidity (%) | Cooking Temperature (°C) | Ramp Time (min) | Cooking Time (min) |
|---|---|---|---|---|---|---|---|
| Aspen Hardwood | 130 | 17.0 | 4:1 | 23.0 | 165 | 90 | 90 |
| Eucalyptus Hardwood | 130 | 17.0 | 4:1 | 23.0 | 165 | 90 | 90 |
| Pine Softwood | 130 | 16.0 | 4:1 | 34.0 | 177 | 60 | 70 |

FIG. 6. Kappa Numbers from Chemical Pulps

| Sample ID | [1]Kappa Number |
|---|---|
| Aspen Control | 15.0 |
| Aspen DEO | 11.0 |
| Aspen OA | 12.0 |
| Eucalyptus Control | 14.0 |
| Eucalyptus DEO | 11.0 |
| Eucalyptus OA | 12.0 |
| Pine Control | 32.0 |
| Pine DEO | 30.0 |
| Pine OA | 29.0 |

[1]Kappa determined by TAPPI (T-236) titration.

FIG. 7 Total amount of carbohydrate released from the wood
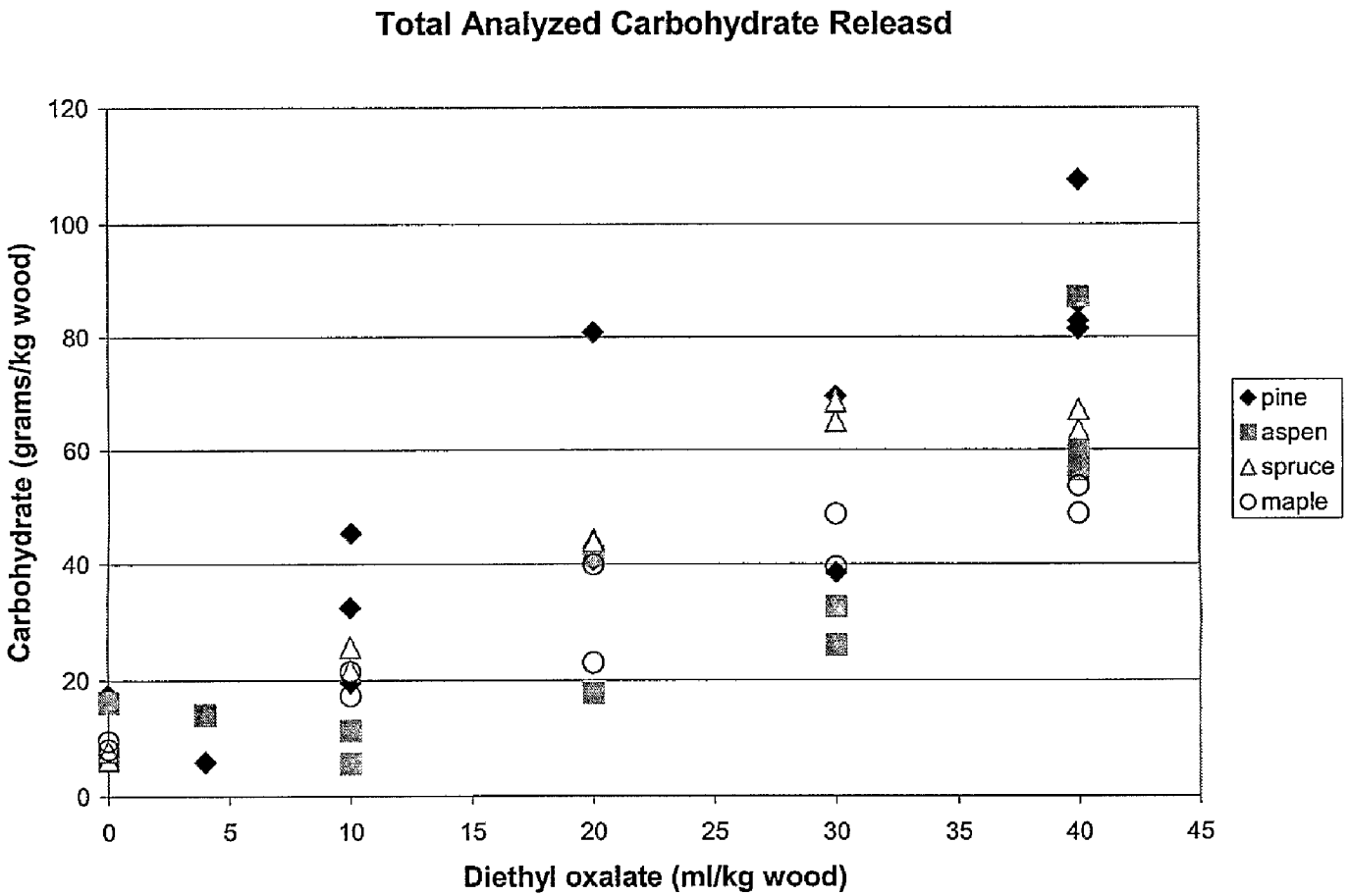

FIG. 8 Time and temperature versus compound release
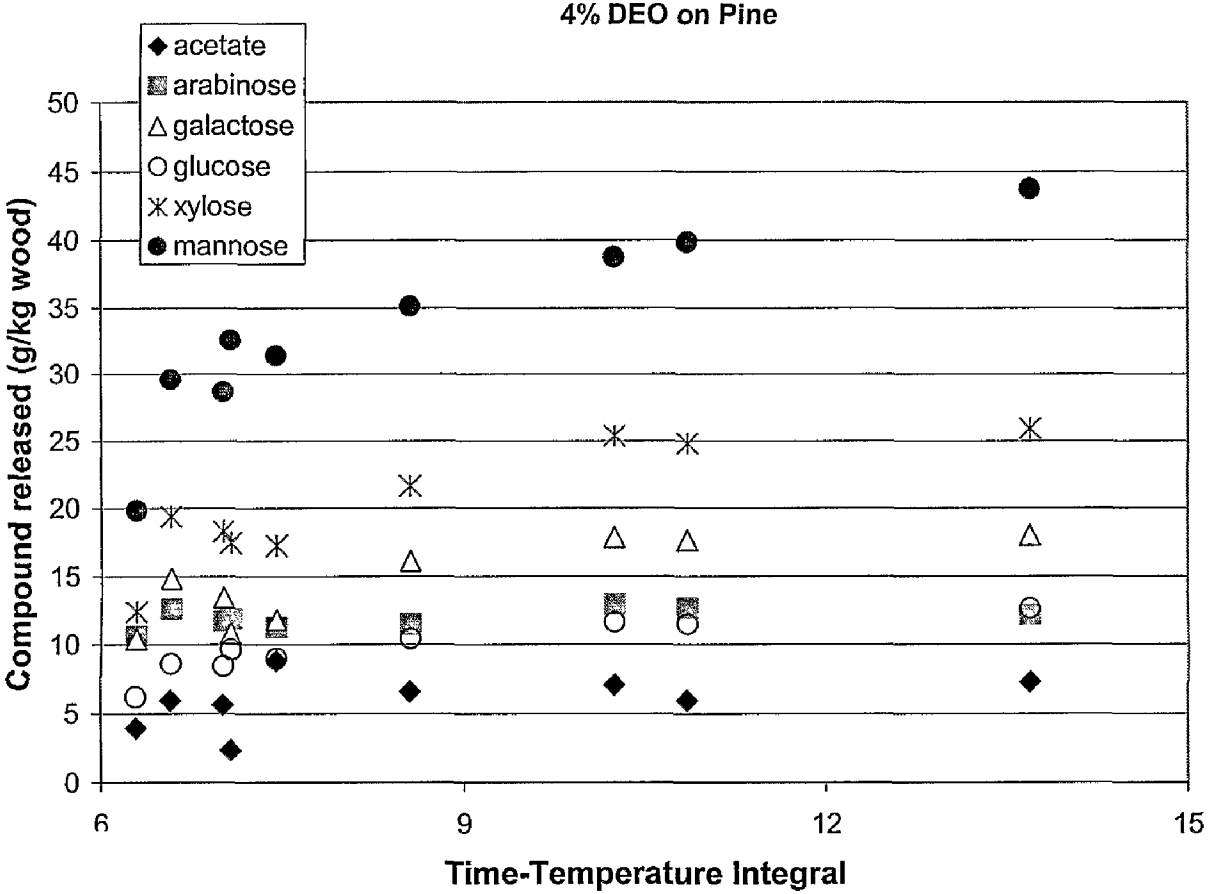

FIG. 9. Microbial sugar metabolism

| Sugars | Arab | Gal | Glu | Xyl | Man |
|---|---|---|---|---|---|
| % monosaccharide | 89 | 38 | 25 | 56 | 30 |
| % total used- *P. stipitis* | 80 | 45 | 66 | 93 | 48 |
| % total used- *S. cerevisiae* | 5 | 46 | 44 | 6 | 35 |

**FIG. 10. *In vitro* rumen digestion.**

| Wood species/treatment | Average gas produced (ml/gm dry matter) at 24 hours | Average gas produced (ml/gm dry matter) at 96 hours |
|---|---|---|
| **Oak** | | |
| Control | 31.30 | 88.92 |
| OA (130/10/0.33) | 25.21 | 76.85 |
| OA (130/10/1.86) | 49.07 | 123.37 |
| 10 ml DEO/kg | 35.45 | 96.08 |
| 40 ml DEO/kg | 51.91 | 108.69 |
| **Mixed hardwoods** | | |
| Control | 32.62 | 90.04 |
| OA (130/10/0.33) | 39.34 | 86.37 |
| OA (130/10/1.86) | 45.37 | 114.42 |
| 10 ml DEO/kg | 44.35 | 109.18 |
| 40 ml DEO/kg | 77.92 | 145.94 |

METHOD FOR TREATING LIGNOCELLULOSIC MATERIALS

CROSS-REFERENCE TO RELATED APPLICATIONS

This application claims priority to U.S. Provisional Patent Application No. 60/697,507 filed Jul. 8, 2005, incorporated by reference in its entirety herein.

STATEMENT REGARDING FEDERALLY SPONSORED RESEARCH OR DEVELOPMENT

This invention is jointly owned with and was made with United States Government support. The government has certain rights in this invention.

STATEMENT REGARDING FEDERALLY SPONSORED RESEARCH OR DEVELOPMENT

Not Applicable

BACKGROUND OF THE INVENTION

Lignocellulosic materials are sources for the generation of a variety of products. Some of the products retain significant structural components of the lignocellulose such as mechanical pulp fibers from wood chips. Other compounds such as sugars derived from the carbohydrate in lignocellulose are made into products by fermentation or chemical conversion. The lignocellulose can be made into products that represent a continuum of structured to molecular products. The continuum of products is generated by a variety of physical, chemical, biological and thermal processes.

In manufacturing paper from wood, the wood is first reduced to an intermediate stage in which the fibers in the wood are separated from their natural environment and transformed into a viscous liquid suspension called pulp. One of the components of wood is lignocellulose. The most abundant component of lignocellulose are the cellulose polymers. These are the most desired polymers in the final pulp product. The second most abundant polymer, and least desirable pulp component of lignocellulose, is lignin. Lignin is undesired because substantial amounts of lignin in pulp can reduce the smoothness of the final paper product and cause the paper to discolor when exposed to light. Lignin can also cause the pulp fibers to be rigid and weak.

The third major component of lignocellulose is the hemicellulose. Hemicelluloses are polymers of sugars that are more heterogeneous than cellulose. The hemicelluloses are comprised of oligomeric sugars derived from arabinose, galactose, xylose and mannose in addition to glucose. The hemicellulose and the lignin are intermixed with the cellulose in lignocellulose and serve to protect the cellulose from damage by organisms, enzymes or chemicals. Removal of the hemicellulose and lignin is often a portion of lignocellulose processing.

Pulp may be produced from various types of lignocellulose using any one of several pulping techniques. The simplest of these techniques is the refiner mechanical pulping (RMP) method in which a mechanical milling operation grinds or abrades wood in water until a desired state of freeness (an arbitrary measure of water drainage) is achieved between its fibers. The RMP method is high yield, typically converting approximately 95% of the dry weight of the wood into pulp. The RMP method, however, also leaves substantially all of the lignin and hemicellulose in the pulp. As a result, RMP pulps generally provide low strength paper products having an opaque color. These paper products are generally used to manufacture newsprint or other low quality paper products.

Other pulping methodologies include thermo-mechanical pulping (TMP), chemical treatment with thermo-mechanical pulping (CTMP), chemi-mechanical pulping (CMP), and the chemical pulping, sulfate (kraft) or sulfite processes. In the chemical based methods, a chemical/water solution is generally used to dissolve the lignin and hemicellulose to promote the separation of the fibers. The absence of lignin, in turn, makes the final paper products stronger and less prone to discoloration. These products often include paper bags, shipping containers, printing and writing papers, and other products requiring strength.

In thermo-mechanical processes (e.g. TMP and CTMP), high temperatures are used to separate the fibers during refining. These processes generally require the refining to be carried out in one or more steps. The first step is usually a pressurized step with refining being performed at temperatures above 100° C. and immediately below or at the softening temperature of lignin. During this step, the pulp is typically mechanically processed using the RMP method. In subsequent steps, the pressure and temperature is usually modulated to achieve the desired state of freeness between the fibers.

Relatively high total electric energy amounts or high quantities of input lignocellulose are required to produce pulps using the above mentioned pulping techniques. In particular, high energy inputs are generally required to obtain fiber separation in woods rich in lignin as such woods typically call for extended refining periods and higher refining temperatures or pressures. Recent studies have also suggested that even thermal or chemical softening treatments of such woods do not guarantee a lower total energy consumption. This is because unprocessed fibers which are only mildly separated by the thermal or chemical treatments are difficult to fibrillate during the refining mechanical process.

Fibrillation is necessary to increase the flexibility of the fibers and bring about the fine material characteristics of quality processed pulp. In fact, it has been suggested that a decrease in the energy consumption from an established level in various TMP and CTMP processes has been associated with the deterioration of certain pulp properties, including a reduction in the long fiber content of the pulp, a lower tear strength and tensile strength, and a higher shives content. (See U.S. Pat. No. 5,853,534, incorporated herein by reference). As a result, high energy consumption in TMP and CTMP processes has been generally necessary in today's pulping practices.

An improved method is needed for producing pulp which is energy efficient, produces paper having improved properties, with fewer undesirable process byproducts (especially environmentally objectionable byproducts), and with an increased production of useable high end desirable products e.g. hemicellulosic sugars. A method shown to affect critical components of the lignocellulose such as the hemicellulose should be useful for pulping lignocellulose and also to prepare lignocellulose for total dissolution into sugars and lignin.

SUMMARY OF THE INVENTION

Briefly, in one aspect, the present invention is a novel method for producing a pulp from a fibrous lignocellulose material or source using a treatment or pretreatment step which exposes the material to oxalic acid derivatives, particularly dialkyl ester derivatives, particularly in the vapor phase. Once treated, the material may be refined using any one of the several pulping methods to produce a final pulp product and the production of the product is accompanied by strength increases in paper made from the pulp and energy savings in making the pulp. In addition the treatment or pretreatment produces a soluble carbohydrate source for further product development. In certain cases a pulp product is not produced and all of the carbohydrate present in the lignocellulose is converted into soluble sugars.

In one embodiment, the method includes heating the fibrous lignocellulose material at a temperature of between about 90° C. and 170° C., more suitably between 130° C. and 140° C., in the presence of oxalic acid derivatives, suitably in the vapor phase, prior to refining the material into a pulp. The dry weight amount of oxalic acid derivative employed may be less than about 6%, or suitably less than about 5%, or more suitably between about 0.05% and 5%, or most suitably between about 1% and 3%, of the dry weight of the fibrous lignocellulose material. The treatment may be conducted at ambient pressures or higher, and for a period of time sufficient to allow the treated product to be later refined at reduced energy input levels as compared to untreated materials, typically less than about 4 hours. Once treated, the treated material may then be refined to form a pulp used to produced a final paper product or could be hydrolyzed by enzymes or acid into soluble carbohydrates.

BRIEF DESCRIPTION OF THE DRAWING(S)

FIG. 1 is a table showing data on the making of, and the paper made from, southern yellow pine treated by the method of the present invention.

FIG. 2 is a table showing data on the making of, and the paper made from, spruce treated by the method of the present invention.

FIG. 3 is a table showing data on the making of, and the paper made from, aspen treated by the method of the present invention.

FIG. 4 is a table showing data on the making of, and the paper made from, maple treated by the method of the present invention.

FIG. 5 is a table showing chemical pulping conditions of wood treated by the method of the present invention.

FIG. 6 is a table showing Kappa numbers from chemical pulps made from wood treated by the method of the present invention.

FIG. 7 is a chart that shows the amount of carbohydrate released by wood treated by the method of the present invention.

FIG. 8 is a chart that shows the amount of release of various compounds from wood treated by the method of the present invention as a function of time and temperature.

FIG. 9 is a table that shows microbial sugar metabolism of sugars produced by the treatment of wood by the method of the present invention.

FIG. 10 is a table that shows the residual cellulose in the treated wood chips is more readily converted to gas by rumen microorganisms.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use of "including", "having" and "comprising" and variations thereof herein is meant to encompass the items listed thereafter and equivalents thereof as well as additional items and equivalents thereof.

It also is understood that any numerical value recited herein includes all values from the lower value to the upper value. For example, if a temperature range is stated as 100° C. to 170° C., it is intended that values such as 101° C. to 110° C., 102° C. to 105° C., etc., are expressly enumerated in this specification. These are only examples of what is specifically intended, and all possible combinations of numerical values between the lowest value and the highest value enumerated are to be considered to be expressly stated in this application.

DETAILED DESCRIPTION OF THE INVENTION

The present invention is a method for treating lignocellulosic materials so as to produce pulp and/or sugars from fibrous lignocellulosic materials using a treatment or pretreatment step which exposes the material to oxalic acid or oxalic acid derivatives. In general, the step includes heat treating the fibrous lignocellulosic material (e.g., wood) in combination with oxalic acid derivatives. Once treated, the fibrous material may be refined using any one of several pulping methods to produce a pulp product and the released sugars recovered for other products.

The treatment method of the invention removes hemicellulose from both hardwoods and softwoods. Since the method releases hemicellulosic sugars it can be used in systems where hemicellulose is present and might be available for recovery and may or may not have to be removed to create another product from the material. Thus hardwood, softwood chips and bark could be used as well as pulp products and agricultural residues. The aqueous extracts from these treatments can support the growth of yeast that produce ethanol. The evaporated sugar solutions can be metabolized by yeast and also mixed rumen microorganisms without inhibition. The residual wood chips resulting from the treatment can be converted to gas by rumen organisms better than untreated materials indicating that the carbohydrates present are accessible to the microorganisms and would also be accessible to digestive enzymes. The treatment of lignocellulosic materials by this process provides a hemicellulosic hydrolysate directly, but the saccharification of lignocellulose to sugars can further be enhanced by enzymes or further acid hydrolysis. The method also provides electrical energy savings in the production of pulp. The pre-treated lignocellulosic materials produce a stronger paper product from the pulp. The paper product from softwoods such as spruce or pine have improved optical properties with increases in brightness, opacity and scattering. For chemical pulping there is an increase in total and screened yield from the pretreated wood chips compared to control chips with a decrease in kappa, required active alkali and residual alkali. The range of products being able to be crafted from the materials treated by the process would include paper and board products, fiber, sugars and oligosaccharides, precursors to food, chemical or fermentation processes, and components derived from the digestion of the hemicellulose and cellulose polymers.

Fibrous lignocellulosic materials treated in accordance with the present invention are defined to generally include materials containing cellulose polymers, hemicellulose polymers and lignin. These materials typically include matter capable of being processed into pulp for making paper products. Such materials may include, for example, hardwoods (i.e., broad-leafed species) and softwoods (i.e., conifers). More specifically, these materials may include the Southern Yellow Pines, Spruces, Western Hemlock, Aspens, and other smaller diameter trees. The material may also originate from either round wood (e.g., whole trees), residue (e.g., wood scraps left behind from forest and sawmill operations), or recovered paper. Recovered paper may include both pre-consumer recovered paper, such as trimmings and scraps from printing, carton manufacturing, or other converting processes which are reused to make pulp without reaching the final consumer, or post-consumer paper, such as corrugated boxes, newspapers, magazines, and office paper which has been recycled.

Oxalic acid derivative or derivatives (used interchangeably) as used herein is to be broadly construed. In the first instance alkyl and dialkyl mono and diesters of oxalic acid are intended. The alkyl moiety of the esters generally have from about 1 to about 10 carbon atoms, preferably about 1 to 6 and most preferably about 1 to 4 carbon atoms. The alkyl moiety may be substituted, unsubstituted, cyclic, linear, branched or unbranched but is predominantly hydrocarbon in character. Oxalic acid derivatives, in one embodiment could include carboxylic acid derivatives other than esters, e.g., amides, acid halides, and anhydrides. Preferred oxalic acid derivative in the practice of this invention are the methyl and ethyl diesters of oxalic acid. Generally, the oxalic acid derivatives that can be used in the present invention, include oxalic acid derivatives for formula (I)

(I)

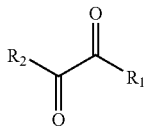

wherein $R_1$ and $R_2$ are independently hydroxyl, oxygen, a halide, a substituted or unsubstituted amine, $OR_3$ or a side chain of formula (II):

(II)

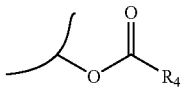

wherein $R_3$ and $R_4$ are independently a branched or unbranched, cyclic or linear, saturated or unsaturated, substituted or unsubstituted alkyl of from 1 to 10 carbon atoms; and wherein $R_1$ and $R_2$ cannot both be hydroxyl.

In general, prior to beginning the pretreatment process, the fibrous lignocellulose material is first reduced to a size appropriate for pulping. Methods of reducing fibrous lignocellulosic material to appropriate sizes for pulping are well known in the art. Reducing the size of the fibrous lignocellulose material aids in having the material sufficiently treated with the oxalic acid derivative. In one embodiment, the material to be treated is reduced to wood chips. Generally acceptable size for wood chips include chips in a size range of 1 mm to 100 mm in length. It is anticipated, however, that the present method may also be effective with materials not reduced to wood chips, such as those materials derived from recovered paper or wood residues or logs themselves. It is also anticipated that the present method may also be effective in treating pulp itself.

The reduced fibrous lignocelluosic material is then treated with an amount of an oxalic acid derivative. The level of oxalic acid derivative used is empirically derived for the species of wood and the end use of the fiber. Higher concentrations may be used to recover hemicelluloses from wood chips destined for chemical pulps or total saccharification (enzymatic or second acid hydrolysis) than can be used for those to be used for mechanical and thermomechanical pulps. Generally, the amount of oxalic acid derivative employed, as expressed in dry weight percentage, may be less than about 6%, or suitably less than about 5%, or more suitably between about 0.05% and 5%, or even more suitably between about 1% and 3%, of the dry weight of the fibrous lignocellulosic material.

In one embodiment, the method comprises adding dimethyloxalate or diethyloxalate oxalic acid esters in the presence of heated wood chips, pulp or any lignocellulosic source that has some water of hydration. Suitably the wood chips are first heated in a digester, using direct atmospheric steam injection to exclude air from the digester and bring the chips up to a temperature required for reaction. The digester is then suitably brought up to around 30 psi steam (although 0 to 90 psi steam can be used) pressure by a combination of steam injection and jacket pressure. This is continued until a stable temperature and pressure are obtained. The temperature used is generally greater than 100° C., typically between 130° C. and 140° C. No upper limit has been established and temperatures of 170° C. have been used to extract sugars, however temperatures above 140° C. can be detrimental to the optical properties of thermomechanical pulp obtained.

The dimethyloxalate or diethyloxalate is injected into the digester by gas pressure, suitably using carbon dioxide or nitrogen. Generally, the pressure of the reaction increases slightly due to the vaporization of the chemical and diminishes within 2-3 minutes. The diethyloxalate or dimethyloxalate oxalic acid esters rapidly vaporize and have significant vapor pressures allowing for the delivery of the chemical into wood chips. The vaporized chemical contacts water present within the wood chips and at least one ester hydrolyzes to liberate acid which acidifies the water. Since the water is kept to a minimum the acid concentration is high and proportional to the amount of chemical injected. The elevated temperature and localized acidity combine to hydrolyze the hemicellulosic sugars present in the wood chip. Other reactions such as esterification and transesterification are also possible during this incubation. The delivery of the reactants in the vapor phase provides a high concentration of acid at the water surface layer in the chips instead of impregnating the chips with an aqueous solution.

The oxalate ester will generate a vapor concentration of the chemical that is dependant on the volume of the vessel and amount of chemical used. Increasing the concentration of the oxalate ester in the vessel will increase the amount of carbohydrate liberated from a given weight of wood chips. A threshold value of oxalate ester has been observed, under a set time and temperature, in pine and spruce where the increase in sugars liberated decreases relative to the increase of oxalate ester used. Adding more oxalate ester after this amount of reaction can damage the fiber for thermomechanical pulp manufacture but does not affect the fiber length of the kraft fiber from the process. This threshold value has not been observed for liberation of hemicellulosic sugars from aspen and maple. In one embodiment, a range of 0 to 100 ml of diethyl oxalate has been used for the treatment of aspen, oak, maple, southern yellow pine, red pine and spruce in a reactor with a total volume of 21.4 liters. In this embodiment, increasing the wood chips (from 1.25 kg to 2.5 kg oven dry basis) increased the amount of hemicellulosic sugars liberated from the wood chips.

Suitably, the treated wood chips are maintained at a steady temperature for at least 30 minutes before being removed from the digester, however any time range between 5 minutes and 2 hours can suitably be used. Maintaining the wood chips in the digester for a more extended time will release more hemicellulosic sugars. Increasing the temperature of reaction or chemical loading will also release more hemicellulosic sugars.

The sugars and other wood hydrolysate products can be recovered by multiple methods of extraction available to those skilled in the art. These methods can include aqueous and non aqueous extraction in a variety of post treatment stages. The wood chips can be extracted by; washing, direct equilibrium, counter current, vacuum, or compressive methods. Likewise pulp or ground wood can be extracted by these same methods.

Sugars, oligosaccharides and other wood hydrolysates products can be converted by biological (including transformation by organisms or enzymatic methods), chemical (including electrochemical and thermochemical) and physical (including evaporation, crystallization, thermal and compressive) means to desired products. Ethanol and organic acids can be made from these materials, but to those skilled in the art the conversion of sugars to these and a variety of products is possible.

The extracted, washed wood chips are then prepared for pulping. Many pulping methods are suitable for the present invention including mechanical and chemical pulping methods. Mechanical pulping methods include mechanical pulping, thermo-mechanical pulping (TMP), chemical treatment with thermo-mechanical pulping (CTMP), and chemi-mechanical pulping (CMP). Chemical pulping methods include chemical pulping, sulfate (kraft) and sulfite processes. Suitably, the wood chips are used for thermomechanical pulp generation. Thermomechanical pulp generation with treated chips have been shown to provide energy savings from 25 to 50%. Treatment of the wood chips with excess diethyl oxalate increases the energy savings but lessens the strength of the resulting handsheets. Wood chips that have been extracted are also suitable for chemical pulping where the fiber length has not been adversely affected by even the highest level of chemical tested. Mechanical pulp has also been made where refiner energy savings are comparable to thermomechanical pulp electrical energy savings and the handsheet strength was similar to the control.

In one embodiment, when the treated wood chips are subjected to mechanical pulping, dilution water is added to the treated material and the material is run through a mechanical refiner in a number of sequential passes. The number of passes of the treated material/pulp mixture will depend upon the freeness desired for the particular paper application to be made. The treated material/pulp mixture is repeatedly fed through refiners until the desired level of freeness is achieved. Thus freeness may be periodically monitored to determine the progress of the pulps toward the freeness level which is desired for the paper. The pulp may also be dewatered as necessary between passes. Loblolly pine, treated using the procedures described above, requires between about 2 to 6 repeated passes to obtain a 100 ml CSF value in a single rotating 300 mm diameter disk atmospheric refiner.

The overall energy efficiency of the process can be compared with that of a standard process by pulping untreated material in the same apparatus while at the same time monitoring the energy consumption of the refining mill itself. Generally speaking the treated material requires significantly less energy input through the refiner to achieve the same level of freeness in the resulting pulps.

The pulps made through this procedure may then be made into paper using standard papermaking techniques. Standard techniques (as described by the Technical Association of the Pulp and Paper Industry, TAPPI) known to work with refined pulps work well with pulps of the type created by the process described herein. Paper made from the pulp prepared according to the present invention (treated pulp) can be compared in quality, strength and texture to that created using untreated material and standard pulping methods. Here, the treated pulp exhibits significantly increased strength properties, thus indicating that the process of the present invention does not sacrifice the quality or strength of the paper in order to achieve the highly desirable energy savings and sugar solutions. In fact, the present invention provides a unique combination of significant reduction in energy use with an increase in the strength properties of the resulting paper.

As is discussed above the process herein disclosed generally involves a treatment of wood chips for the liberation of hemicellulosic sugars and the subsequent use of the wood chips for paper products. By altering process variables more or less sugar can be liberated from the wood chips. The optimal sugar recovered depends on the type of source material and the nature of the product. Thermomechanical pulp and mechanical pulp contain hemicellulose and removal of too much hemicellulose will affect the strength and yield of the paper. Chemical pulp is created from the cellulosic material in wood and more hemicellulosic sugars can be recovered from wood without affecting the strength of the paper derived from the pulp. Total saccharification would convert the sugars in lignocellulose to fermentable carbohydrate and would leave a lignin residue.

Pulping treatments, with the exception of sulfur dioxide, take place in solution. Sulfur dioxide works to pretreat wood chips but it damages the cellulosic component of the fiber. Infiltration and impregnation of the wood chips with a pulping liquor is an important feature of most pulping systems including sulfite and kraft pulping. The nature of the wood may place limitations on the penetration of a given chemical. Bordered pits in tracheids from softwood species can be aspirated which limits the penetration of liquid. For example, in one embodiment the treatment of pine with diethyl oxalate fragments the torus of the bordered pits which allow better chemical penetration for extraction of hemicellulosic sugars and improves the subsequent impregnation of liquor into the wood chips.

The invention thus provides 1) a potential sugar source for chemical reactions and fermentation, 2) energy savings in the generation of mechanical and thermomechanical pulps, 3) an improved wood chip for production of chemical pulp and 4) enhanced availability of the cellulose for further conversion to sugars. The use of the invention is likely to improve the economics for the production of thermomechanical and mechanical pulps from small diameter material that must be removed from the crowded forests. The use of this process as a pretreatment for chemical pulping would likely lessen the chemicals required for pulping and enhance the profit of chemical pulping by providing a new product stream. The generation of a commodity scale carbohydrate stream will allow for fuels to be developed from the material and lessen the national dependence on foreign oil.

It also should be noted that the present invention process is likely to be adopted for use in what is referred to in the industry as the RTS (Residence, Temperature, and Speed) process described in the issued U.S. Pat. Nos. 5,774,305, 6,165,317, and 6,364,998 all of which are incorporated by reference herein, and U.S. Patent Application Publications US2001/0050151 and US2005/0011622 both incorporated by reference herein.

The present invention is further explained by the following examples which should not be construed by way of limiting the scope of the present invention.

EXAMPLE 1

Mechanical Pulping of Southern Yellow Pine Treated with Diethyloxalate

Southern yellow pine (*Pinus taeda*) wood chips were obtained from Bowater Inc, South Carolina. Wood chips of a nominal size of 8-18 mm were placed in barrels and frozen to prevent the growth of contaminating microorganisms. Solids content was 48%.

Diethyloxalate (DEO) from Sigma-Aldrich was used in the quantities of 10 ml and 40 ml per kilogram oven dried wood chips. Chips, 2.5 kg oven dry basis, were placed in the stationary digester and steam introduced to displace air and bring the chips to temperature (135-140° C.). A Dickson HT100 temperature probe was included in the chips to record temperature. Additional temperature measurements were made using an inserted thermocouple and Rustrak Ranger IV 1600 series software. When at temperature the DEO was introduced by an injector pipe attached to the top of the digester and forced into the digester using carbon dioxide or nitrogen gas pressure. Wood chips were treated at temperature for 30 minutes after DEO addition. Controls experienced the same heating conditions, but no chemical addition. After treatment the chips were immersed in reverse osmosis water and placed in the cold room to extract hemicellulosic sugars. The chips were drained after 40 hours and kept cold until refined.

Cooked wood chips were refined in a Sprout-Bauer pressurized laboratory refiner, Model 12-ICP 300 mm diameter single rotating disk. Energy consumption was measured using an Ohio Semitronic Model WH 30-11195 Integrating Wattmeter attached to the power supply side of the 44.8 kW electric motor. Feed rate through the refiner resulted in a power load between 50 HP and 60 HP. Energy reported in W·h/kg. Refiner plate setting was 0.010 inch.

Pulp samples were further refined in a Sprout-Waldron Model D2202 300 mm diameter single rotating disk atmospheric refiner. Energy consumption was measured using an Ohio Semitronic Model WH 30-11195 Integrating Wattmeter attached to the power supply side of the 44.8 kW electric motor. Feed rate through the refiner resulted in a power load between 10 kW and 15 kW. Energy reported in W·h/g. Refiner plate settings were 0.025 inch, 0.014 inch, 0.010 inch, and 0.008 inch. Pulp was collected at each pass as a hot water slurry. Between the passes the pulp slurry was dewatered to approximately 25% solids in a porous bag by vacuum. Dilution water at 85° C. was then added each time as the pulp was fed into the refiner. Samples of the pulp were taken and tested for Freeness (CSF). Samples were refined to bracket 100 CSF. Handsheets were prepared and tested using TAPPI standard testing methods.

Energy savings and handsheet improvements are evident from the data presented in FIG. 1. Energy savings comparison requires that the freeness level be the same. The energy required for TMP varies as a function of the freeness. The data of energy was plotted as a function of freeness and the line fitted to a power function. The energy required to process the control to 100 CSF was 2,452 W·h/kg on a dry wood basis. The 10 ml DEO/kg treated material (dry weight basis) required 1,516 W·h/kg for an energy savings of 38.2% and the 40 ml DEO/kg treated material required 1,106 W·h/kg for an energy savings of 54.9%.

In addition to the energy savings there are improvements in the strength properties of the paper. Tear, tensile and burst indexes are all improved over that of the control. The brightness, printing opacity, and scattering coefficient of the paper were also increased over that of the control. These results are surprising because a chemical pretreatment prior to mechanical pulping typically reduces optical properties.

It is surprising that the treatment of wood chips with DEO would result in manifold improvements in the TMP process. The handsheet strength indexes are all improved and significant energy savings realized at the same time. In addition to this the brightness is also improved. In prior art, usually improvements with brightness (from bleaching) are accompanied by reduction in the opacity and scattering coefficient. Here there are improvements in all the optical properties.

EXAMPLE 2

Mechanical Pulping of Spruce Treated with Diethyloxalate

Spruce logs were donated by Stora Enso North America (SENA), Biron Division, Wisconsin Rapids, Wis. The logs were debarked by hand, chipped (19 mm), screened to remove pieces greater than 38 mm and less than 6 mm, separated into fractions by a second screen (22 mm), and bagged and stored frozen until used. Wood chips of a nominal size of 22 mm were used. Solids content was 55%. DEO was used in the quantities of 10 ml and 20 ml per kilogram oven dried wood chips. All other DEO pretreatment conditions as in Example 1. Chip fiberization, pulp refining and handsheet production was done as in Example 1.

Energy savings and handsheet improvements are evident from the data presented in FIG. 2. Energy savings comparison requires that the freeness level be the same. The energy required for TMP varies as a function of the freeness. The data of energy was plotted as a function of freeness and the line fitted to a power function. The energy required to process the control to 100 CSF was 2,972 W·h/kg. The 10 ml DEO/kg treated material required 2,068 W·h/kg for an energy savings of 30.4% and the 20 ml DEO/kg treated material required 1,718 W·h/kg for an energy savings of 42.2%.

In addition to the energy savings there are improvements in the strength properties of the paper. The tear and burst indexes are improved over that of the control. The brightness, printing opacity and scattering coefficient of the paper were also increased over that of the control.

As above in Example 1, it is surprising that the treatment of spruce wood chips with DEO would result in manifold improvements in the TMP process. The tear index is improved and significant energy savings realized at the same time. In addition to this the brightness, opacity, and scattering coefficient were also improved.

Since the energy savings and handsheet properties are improved for two different softwoods it is likely to be a property of the treatment that will be applicable to all softwoods.

EXAMPLE 3

Mechanical Pulping of Aspen Treated with Diethyloxalate

Aspen logs were donated by SENA, Biron Division, Wisconsin Rapids, Wis. All chipping and screening as in Example 2. Solids content was 48%. DEO was used in the quantities of 10 ml and 40 ml per kilogram oven dried wood chips. All other DEO pretreatment conditions as in Example 1. Chip fiberization, pulp refining and handsheet production were done as in Example 1.

Energy savings and handsheet improvements are evident from the data presented in FIG. 3. Energy savings comparison requires that the freeness level be the same. The energy required for TMP varies as a function of the freeness. The data of energy was plotted as a function of freeness and the line fitted to a power function. The energy required to process the control to 100 CSF was 3,715 W·h/kg. The 10 ml DEO/kg treated material required 3,164 W·h/kg for an energy savings of 15% and the 40 ml DEO/kg treated material required 1,224 W·h/kg for an energy savings of 67%.

In addition to energy savings there is evidence that the strength indexes have also shown improvement. As above for Examples 1 and 2, it is surprising that the treatment of aspen wood chips with DEO would result in manifold improvements in the TMP process. The handsheet strength indexes are all improved and significant energy savings realized at the same time.

EXAMPLE 4

Mechanical Pulping of Maple Treated with Diethyloxalate

Maple logs were provided by Weyerhaeuser, Rothschild, Wis. All chipping and screening as in Example 2. Solids content was 59%. DEO was used in the quantities of 10 ml and 40 ml per kilogram oven dried wood chips. All other DEO pretreatment conditions as in Example 1. Chip fiberization, pulp refining and handsheet production were done as in Example 1.

Energy savings and handsheet improvements are evident from the data presented in FIG. 4. Energy savings comparison requires that the freeness level be the same. The energy required for TMP varies as a function of the freeness. The data of energy was plotted as a function of freeness and the line fitted to a power function. The energy required to process the control to 100 CSF was 3,414 W·h/kg. The 10 ml DEO/kg treated material required 1,941 W·h/kg for an energy savings of 43.1% and the 40 ml DEO/kg treated material required 866 W·h/kg for an energy savings of 74.6%.

In addition to the energy savings there are improvements in the strength properties of the paper. Tear, tensile and burst indexes are all improved over that of the control.

As above in Examples 1-3, it is surprising that the treatment of maple wood chips with DEO would result in manifold improvements in the TMP process. The handsheet strength indexes are all improved and significant energy savings realized at the same time. Since the energy savings and handsheet properties are improved for two different hardwoods it is likely to be a property of the treatment that will be applicable to all hardwoods.

EXAMPLE 5

Chemical Pulping of Wood Treated with Oxalic Acid and Diethyloxalate

Loblolly pine wood chips were obtained from Bowater, Inc. of South Carolina. Logs were debarked and chipped at Bowater to a nominal size of 6-14 mm. Chips were placed in barrels and frozen to prevent the growth of contaminating microorganisms. Solids content is 43.0%.

Eucalyptus wood chips were obtained from Melhoramentos Papeis in Sao Paulo, Brazil. Upon arrival the wood chips were bagged and frozen to prevent the growth of contaminating microorganisms. Solids content is 51.0%

Aspen wood chips were obtained from northern Wisconsin. Logs were debarked and chipped at SENA to a nominal size of 6-14 mm. Chips were placed in barrels and frozen to prevent the growth of contaminating microorganisms. Solids content is 48.3%.

OA (oxalic acid) purchased from Sigma-Aldrich was impregnated into the wood chips as a solution of 0.33% concentration. The wood chips were pretreated in a batch digester at the desired temperature (130° C.) and time duration (10 min). An internal type Y thermocouple measured temperature. After pretreating, the wood chips were extracted in water overnight and frozen until subsequent treatment by the kraft cooking process.

DEO (diethyloxalate) was purchased from Sigma Aldrich and used in the amount of 40 ml per 1.0-kilogram oven dried wood chips for softwoods and 20 ml per 1.0-kilogram oven dry wood chips for hardwoods. The wood chips were pretreated in a batch digester at the desired temperature (140° C.) and time (30 min). An internal type Y thermocouple measured temperature. After pretreating, the wood chips were extracted in water overnight, drained and frozen until subsequent treatment by the kraft cooking process.

FIG. 5 shows the conditions for the kraft process that were employed for each of the pretreatments.

FIG. 6 shows that OA and DEO-treated wood chips provide a benefit to chemical pulping. Treated and control chips were cooked and the kappa level determined. Under the same cooking conditions the kappa was lower for the treated chips in each case, which will translate into savings in cooking chemicals, bleaching chemicals or both.

Both DEO and OA pretreatments followed by hemicellulose extraction resulted in benefits for the chemical pulping process for both softwoods and hardwoods. The chemical process used in these sets of experiments was the kraft process. A reduction in kappa number for each species of wood was noted in each treatment. Kappa number decrease over the control is beneficial for cost savings in cooking chemicals, bleaching chemicals or both.

It is surprising that these OA and DEO pretreatments prior to chemical cooking would result in a lower kappa number when cooked under the same conditions as the control. The experiments above are sufficient to conclude that all hardwoods and softwoods (or a starting material that is a combination of the two) will exhibit these benefits for both OA and DEO pretreatments prior to chemical pulping.

EXAMPLE 6

Saccharification of Wood Treated with Diethyloxalate

Southern yellow pine wood was prepared in chips as in Example 1, spruce wood was prepared in chips as in Example 2, aspen wood was prepared in chips as in Example 3, and maple wood was prepared in chips as in Example 4. DEO was used in the range of 0 to 40 ml per kilogram oven dried wood chips. All other DEO pretreatment conditions are the same as in Example 1.

The water of extraction as described in Examples 1-4 was analyzed by measurement of the total water present and analysis of the carbohydrate content of the water. Sugar contents of the extracts were determined by high performance anion exchange chromatography using pulsed amperometric detection HPAEC/PAD. To determine monosaccharide concentrations, extracts were injected with no prior treatment. To determine total carbohydrate content of extracts (monosaccharide, polysaccharide, and any carbohydrate derivatives with acid-labile moieties), extracts were brought to 4% (w/w) $H_2SO_4$ and a hydrolysis performed for 1 h at 120° C. (standard samples were also analyzed). Fucose was used as an internal standard in all cases.

FIG. 7 shows the results of total released carbohydrate (glucose+galactose+mannose+xylose+arabinose) for 4 different species of wood upon extraction after DEO treatment at the same conditions (140° C. and 30 minutes). The amount of carbohydrate released was proportional to the amount of DEO added. It is clear from the graph that more chemical addition will remove further carbohydrate from the chips.

FIG. 7 shows that carbohydrate is released from the wood chips and the release is dependent on the amount of DEO added. Data are shown for two hardwood species and two softwood species. FIG. 7 shows the total amount of carbohydrate released from the wood. Approximately 50% of that carbohydrate on a weight basis is present as free sugar (monosaccharide).

In addition to the four species shown below, DEO treated wood chips released carbohydrate from oak, mixed hardwoods, and red pine. Increasing the chemical loading for the same treatment temperature and time increased the amount of carbohydrate released.

Each of the four species listed show an increase in amount of carbohydrate released with increasing chemical treatment. There were increases in all carbohydrate components released and the amounts and types of carbohydrates released were related to the composition and type of hemicellulose in the wood. For the hardwoods the major carbohydrate released was xylose. For the softwoods the major carbohydrate released was mannose. Since both hardwoods and softwoods have been used in these studies, the treatment will work to release carbohydrates from any lignocellulose source. It was surprising that carbohydrate would be released by the treatment. Not shown is the amount of acetic acid released from the wood chips. Acetic acid release increased with increasing chemical loading and the corresponding fiber was decreased in acetyl content by a similar amount. The correlation of the carbohydrate release with the load of applied chemical indicates that the release of carbohydrate is predictable and is correlated with the oxalic acid deposited within the chips.

EXAMPLE 7

Release of Carbohydrate with Increasing Intensity of Time and Temperature of Treatment Southern yellow pine was prepared in chips as in Example 1. DEO was used at 40 ml per kilogram oven dried wood chips. All other DEO pretreatment conditions are the same as in Example 1 except for time and temperature which were varied as described below. Temperature was monitored and its integral over time was calculated.

FIG. 8 shows the results of treatment of wood chips with DEO at increased temperature/time. In Example 6 the chemical loading was shown to affect the amount of sugar released from the chips. Here the data shows that increasing the time and temperature also have marked effects on the carbohydrate released from the chips. As time or temperature are increased the carbohydrate released increases. The types of carbohydrate released are shown in FIG. 8. Importantly the major sugar in softwood hemicellulose is mannose and this is the sugar that increases the most. Glucose does not continue to increase indicating that the cellulose is not degraded.

Simultaneous with the increased carbohydrate release there is also an increase in the amount of acetic acid released from all the wood species tested. The amount of acetic acid released is dependent on the chemical loading, the species of wood (hardwoods release more acetic acid than softwoods), time of treatment, and temperature of treatment. Acetic acid can be recovered as a saleable product from this treatment.

In addition to these results the amounts of carbohydrate from mixed hardwoods were shown for DEO treatments to be increasing as functions of time and temperature.

The release of carbohydrate from southern yellow pine is a function of the severity of treatment with time and temperature. FIG. 8 shows that the increase is due to increased removal of the hemicellulose and not from the cellulose. This indicates that the fiber available after carbohydrate removal could be used for purposes more valuable than conversion to fermentable sugars.

EXAMPLE 8

Use of Carbohydrates Produced by the Method of the Invention by Microorganism Southern yellow pine wood was prepared in chips as in Example 1, spruce wood was prepared in chips as in Example 2, and aspen wood was prepared in chips as in Example 3. DEO was used at 20-40 ml per kilogram oven dried wood chips. All other DEO pretreatment conditions as in Example 1. Extraction water was recovered by screening the chips. To make a complete yeast culture medium the sugar solutions were brought to pH 7 with addition of potassium hydroxide, yeast nitrogen base w/o carbohydrate (Difco) added and the solution filter sterilized. Addition of 10 g/l Bacto-Tryptone (Difco) and 5 g/l yeast extract (Difco) to the sugar solution made a complete medium for *Escherichia coli.*

FIG. 9 is a summary of the metabolism of sugars by *Pichia stipitis* and *Saccharomyces cerevisiae* grown for 48 hours in the extract obtained from pine wood chips treated with 40 ml DEO/kg. Both organisms were able to rapidly metabolize the sugars with no inhibition. These organisms were also able to use sugars from spruce and aspen with similar results. The pentoses are metabolized better by *P. stipitis* and there is also greater metabolism of the total sugars present by *P. stipitis*. This data shows there are limited, if any, inhibitors to fermentation present in the extracts.

In addition to yeast, recombinant *Escherichia coli* was cultured using extracts of red pine (treated as in Example 2 for spruce), spruce, and southern yellow pine as sources of carbohydrate. *E. coli* was able to ferment the sugars to ethanol provided the concentration of acetate was kept below 30 mM.

The data shows that a variety of organisms are able to use the carbohydrate present in the water extracts from DEO treated wood chips. These organisms were able to grow without the extensive conditioning required of some wood hydrolysates.

EXAMPLE 9

Use of Treated Wood Chips in Total Saccharification

Wood chips of oak and mixed hardwoods were treated as described in Example 5. Additional treatment with a 1.86% solution of OA was also included. After water extraction the chips were milled to a coarse fiber prior to being used in in vitro rumen tests. Rumen microorganisms were exposed to coarse fiber in sealed anaerobic vials. Pressure transducers were used to measure the gas evolved from the added substrates. Controls were included for gas production from the rumen fluid and the results reported corrected for those values. Sample times were at 24 hours and 96 hours.

FIG. 10 shows that both OA and DEO treatment of oak and mixed hardwoods increases the accessibility of rumen microorganisms to the cellulosic components in the wood chip. There is a clear increase in the gas produced by the rumen organisms with the amount of chemical used in the wood chip treatment. The controls were heated chips without chemical treatment. The treatment of maple (not shown) with DEO also increased the gas production by rumen microorganisms.

Increased gas production from treated materials compared to controls shows increased cellulose availability to the rumen microorganisms. Rumen microorganisms normally do not grow well with wood as a substrate. The increased gas production indicates the cellulose is more accessible in the treated material than in the controls. Removal of hemicellulose is a known factor in increasing the saccharification of the cellulose to glucose. These data show that DEO or OA treatment of the wood chips will increase the accessibility of the cellulose to microbial degradation. Rumen microorganisms interact with the substrate material by surface contact. This indicates that material ground to the same consistency must be more accessible to the microorganisms in order to have increased gas production. As cellulolytic enzymes used in saccharification studies are much smaller than microorganisms, these data indicate there will be increased access to cellulolytic enzymes.

It is surprising that the DEO or OA treatment would provide greater access to the enzymes of saccharification. These results show two things: 1) Treated wood chips could be developed as a feed for ruminants. 2) Treated wood chips would be improved for the saccharification of all the carbohydrate to sugars via enzyme conversions. The conclusion from this is that the DEO or OA treatment can be a useful pretreatment to enzyme saccharification of wood.

All patents, publications and references cited herein are hereby fully incorporated by reference. In the case of conflict between the present disclosure and the incorporated patents, publications and references, the present disclosure should control.

While the present invention has now been described and exemplified with some specificity, those skilled in the art will appreciate the various modifications, including variations, additions, and omissions that may be made in what has been described. Accordingly, it is intended that these modifications also be encompassed by the present invention and that the scope of the present invention be limited solely by the broadest interpretation that lawfully can be accorded the appended claims.

The invention claimed is:

1. A method for pulping a fibrous lignocellulose material, the method comprising:

(a) treating the material with an oxalic acid derivative to release sugars from the material, wherein the oxalic acid derivative is a compound of formula (I):

(I)

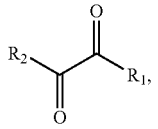

wherein $R_1$ and $R_2$ are independently hydroxyl, a halide, a substituted or unsubstituted amine, $OR_3$, or a side chain of formula (II):

(II)

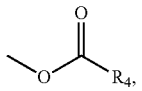

wherein $R_3$ and $R_4$ are independently a branched or unbranched, cyclic or linear, saturated or unsaturated, substituted or unsubstituted alkyl of from 1 to 10 carbon atoms; and wherein $R_1$ and $R_2$ cannot both be hydroxyl; and (b) processing the treated material from step (a) into a pulp.

2. The method of claim 1 wherein $R_1$ is $OR_3$.

3. The method of claim 2 wherein $R_2$ is $OR_3$.

4. The method of claim 3 wherein the oxalic acid derivative is diethyloxalate.

5. The method of claim 3 wherein the oxalic acid derivative is dimethyloxalate.

6. The method of claim 1 wherein the material has a dry weight, and wherein the oxalic acid derivative is present in an amount less than about 6% of the dry weight of the material.

7. The method of claim 1 wherein the material has a dry weight, and wherein the oxalic acid derivative is present in an amount less than about 5% of the dry weight of the material.

8. The method of claim 1 wherein the material has a dry weight, and wherein the oxalic acid derivative is present in an amount between about 0.05% and about 5% of the dry weight of the material.

9. The method of claim 1 wherein the material has a dry weight, and wherein the oxalic acid derivative is present in an amount between about 1% and about 3% of the dry weight of the material.

10. The method of claim 1 wherein the material is heated at a temperature of between 90° C. and 170° C. in step (a).

11. The method of claim 1 wherein the material is heated at a temperature of between 130° C. and 140° C. in step (a).

12. The method of claim 10 wherein the material heated in step (a) is further processed to recover the sugars from the material.

13. The method of claim 1 wherein the oxalic acid derivative material in step (a) is in a vapor phase.

14. The method of claim 1 wherein the processing of step (b) is a chemical pulping process.

15. The method of claim 1 wherein the processing of step (b) is a mechanical pulping process.

16. A method for producing pulp from a fibrous lignocellulose material, the method comprising the steps of:

(a) reducing the material to a size appropriate for pulping;

(b) treating the reduced material with diethyloxalate in a vapor phase to release sugars from the reduced material;

(c) mechanically refining the material treated in step (b) into pulp.

17. The method of claim 16 wherein reduced material has a dry weight, wherein the diethyloxalate is present in an amount less than about 6% of the dry weight of the reduced material.

18. The method of claim 16 wherein the material is heated at a temperature of between 90° C. and 170° C. in step (b).

19. The method of claim 18 wherein the material heated in step (b) is further processed to recover the sugars from the material.

20. The method of claim 16 wherein the fibrous lignocellulose material is wood.

21. A method for treating fibrous lignocellulose material, the method comprising the steps of:

(a) treating a fibrous lignocellulose material with an oxalic acid derivative, wherein the oxalic acid derivative is a compound of formula (I):

(I)

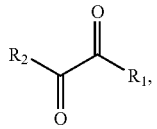

wherein $R_1$ and $R_2$ are independently hydroxyl, a halide, a substituted or unsubstituted amine, $OR_3$, or a side chain of formula (II):

(II)

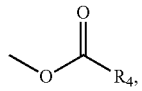

wherein $R_3$ and $R_4$ are independently a branched or unbranched, cyclic or linear, saturated or unsaturated, substituted or unsubstituted alkyl of from 1 to 10 carbon atoms; and wherein $R_1$ and $R_2$ cannot both be hydroxyl;

(b) processing the treated material from step (a) into a pulp; and (c) treating the treated material with rumen microorganisms or hydrolyzing the treated material with enzymes or acid into soluble carbohydrates.

22. The method of claim 21 wherein the material is heated in the presence of the oxalic acid derivative and is further processed to recover sugars released from the material.

* * * * *